US011081832B2

(12) United States Patent
Shinyama et al.

(10) Patent No.: US 11,081,832 B2
(45) Date of Patent: Aug. 3, 2021

(54) TERMINAL SEALING MEMBER, METHOD OF PRODUCING THE SAME, AND CONNECTOR INCLUDING THE SAME

(71) Applicant: Molex, LLC, Lisle, IL (US)

(72) Inventors: Makoto Shinyama, Yamato (JP); Takaaki Hirayama, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/714,791

(22) Filed: Dec. 16, 2019

(65) Prior Publication Data

US 2020/0194925 A1 Jun. 18, 2020

Related U.S. Application Data

(60) Provisional application No. 62/781,027, filed on Dec. 18, 2018.

(30) Foreign Application Priority Data

Apr. 12, 2019 (JP) ..... JP2019-076173

(51) Int. Cl.
*H01R 13/52* (2006.01)
*H01R 13/24* (2006.01)

(52) U.S. Cl.
CPC ..... *H01R 13/521* (2013.01); *H01R 13/2421* (2013.01)

(58) Field of Classification Search
CPC ..... H01R 13/521; H01R 13/2421; H01R 13/6315; H01R 13/5202; H01R 13/17
USPC ..... 439/874, 587, 588, 700, 824, 61
See application file for complete search history.

(56) References Cited

U.S. PATENT DOCUMENTS 5,879,198 A * 3/1999 Sekimori ..... H01R 13/44 439/289
6,152,608 A 11/2000 Ghara et al.
6,431,912 B1 * 8/2002 Mori ..... B60L 53/16 439/587

(Continued)

FOREIGN PATENT DOCUMENTS

CN 104466514 A 3/2015
CN 206585121 U 10/2017

(Continued)

OTHER PUBLICATIONS

Notification of Reason for Refusal received for KR Application No. 10-2019-0169395, dated Feb. 8, 2021, 8 Pages.(4 Pages of English translation and 4 Pages of Official notification).

(Continued)

*Primary Examiner* — Abdullah A Riyami
*Assistant Examiner* — Nelson R. Burgos-Guntin

(57) ABSTRACT

A terminal sealing member is provided which includes a shaft portion and a flange disposed on the shaft portion and attached to a terminal slidable in a front-rear direction, an urging member which is attached around the shaft portion and urges the flange forward, an elastic tubular member which includes a central hole into which the shaft portion is slidably inserted and has the urging member embedded therein, and an elastic adhering member which includes a central hole into which the shaft portion is slidably inserted and is attached to front and back ends of the elastic tubular member.

16 Claims, 11 Drawing Sheets

(56) References Cited

U.S. PATENT DOCUMENTS

| | | | | |
|---|---|---|---|---|
| 7,008,270 | B1 * | 3/2006 | Huh | G02B 6/3821 439/700 |
| 8,469,731 | B2 * | 6/2013 | Gloaguen | H01R 13/187 439/181 |
| 9,077,105 | B2 * | 7/2015 | Kim | H01R 13/2421 |
| 9,391,390 | B2 * | 7/2016 | Endo | H01R 13/5224 |
| 10,622,756 | B1 * | 4/2020 | Tziviskos | H01F 7/02 |
| 2015/0325943 | A1 * | 11/2015 | Frey | H01R 13/512 439/275 |
| 2016/0344132 | A1 | 11/2016 | Hashiguchi | |
| 2018/0183162 | A1 * | 6/2018 | Sakamoto | H01R 12/7076 |
| 2019/0067859 | A1 * | 2/2019 | Sugiura | H01R 11/01 |
| 2019/0379154 | A1 * | 12/2019 | Nishijima | H01R 13/512 |
| 2020/0194925 | A1 * | 6/2020 | Shinyama | H01R 13/6315 |
| 2020/0203881 | A1 * | 6/2020 | Marzano | H01R 13/521 |
| 2020/0244004 | A1 * | 7/2020 | Shinyama | H01R 13/521 |
| 2020/0274288 | A1 * | 8/2020 | Kosaka | H01R 13/501 |

FOREIGN PATENT DOCUMENTS

| | | | |
|---|---|---|---|
| JP | S52-28236 | B2 | 7/1977 |
| JP | S56-154783 | U | 11/1981 |
| JP | 2001504601 | A | 4/2001 |
| JP | 2001-143810 | A | 5/2001 |
| JP | 3750907 | B2 | 3/2006 |
| KR | 200338161 | Y1 | 1/2004 |

OTHER PUBLICATIONS

Notice of Allowance received for KR Application No. 10-2019-0169395, dated May 10, 2021, 3 Pages. (1 Page of English Translation and 2 Pages of Official notification).

* cited by examiner

TERMINAL SEALING MEMBER, METHOD OF PRODUCING THE SAME, AND CONNECTOR INCLUDING THE SAME

RELATED APPLICATIONS

This application claims priority to Japanese Application No. 2019-076173, filed on Apr. 12, 2019, which further claims priority to U.S. Provisional Application No. 62/781,027 filed on Dec. 18, 2018, both of which are incorporated herein by reference in their entireties.

TECHNICAL FIELD

The present disclosure relates to a terminal sealing member, a method of producing the same, and a connector including the same.

BACKGROUND ART

According to the related art, as a terminal assembly used in a connector for electrically connecting an electronic device, an electrical device, or the like to a power source such as a battery, a terminal assembly having a movable terminal that is urged by a coil spring has been proposed for example, see Patent Document 1.

FIG. 11 is a cross-sectional view of a connector according to the related art.

In the drawing, 811 indicates a wall portion of a housing included in the connector, and 812 indicates a terminal housing portion of the housing that is attached to the wall portion 811. Further, 851 indicates a terminal that is slidably housed in the terminal housing portion 812 in a front-rear direction (left-right direction in the drawing). A cable 881 is connected to a rear end of the terminal 851. The cable 881 is a feeder cable connected to a power source such as a battery (not illustrated), and a distal end thereof is inserted into the terminal housing portion 812 through a through-hole formed in the wall portion 811, and is connected to a rear end of the terminal 851.

Further, the terminal 851 includes a flange 853 and a contact protrusion 854 extending forward (toward the left in the drawing) from the flange 853. A front end surface 854*a* of the contact protrusion 854 is a portion that comes into contact with a mating terminal 951 loaded in a mating housing 911 of a mating connector connected to an electronic device, an electrical device, or the like (not illustrated). Furthermore, the flange 853 is a portion that is loaded in the terminal housing portion 812 and receives an urging force of a coil spring 871 to be urged forward. When the connector is connected to the mating connector, the terminal housing portion 812 and the mating housing 911 approach each other to abut each other, the front end surface 854*a* of the contact protrusion 854 comes into contact with the mating terminal 951, and the terminal 851 is pressed rearward (toward the right in the drawing). As a result, the coil spring 871 elastically contracts, and the terminal 851 slides rearward while maintaining a state in which the front end surface 854*a* is in contact with the mating terminal 951.

Furthermore, a sealing member is disposed in the connector to maintain water resistance and dust resistance. Specifically, a front sealing member 833 is disposed around the contact protrusion 854 in front of the flange 853, and a rear sealing member 834 is disposed around the cable 881 disposed adjacent to the wall portion 811.

The front sealing member 833 has an outer circumferential portion fixed to an inner circumferential surface of the terminal housing portion 812, and an inner circumferential portion in contact with an outer circumferential surface of the contact protrusion 854 to thereby function as a seal lip. Further, the rear sealing member 834 is a bellows type tubular member. A front end portion 834*a* of the rear sealing member 834 has an outer diameter smaller than an inner diameter of the terminal housing portion 812 and has an inner circumferential portion in contact with an outer circumferential surface of the cable 881 to thereby function as a seal lip, and a rear end portion 834*b* of the rear sealing member 834 has an inner diameter larger than the outer diameter of the cable 881, and has an outer circumferential portion in contact with the inner circumferential surface of the terminal housing portion 812 to thereby function as a seal lip.

As described above, the front sealing member 833 is disposed around the contact protrusion 854, and the rear sealing member 834 is disposed around the cable 881. Therefore, even when the terminal 851 and the cable 881 connected to the terminal 851 slide within the terminal housing portion 812, water resistance and dust resistance can be reliably maintained.

Patent Literature: Patent Document: Patent Document 1: JP 2001-143810 A

SUMMARY

However, in a case of the connector according to the related art, since structures of the front sealing member 833 and the rear sealing member 834 are complex, costs increase. Furthermore, since attachment structures of the front sealing member 833 and the rear sealing member 834 are also complex, an attachment operation is time consuming and manufacturing costs increase. In addition, since the inner circumferential portion of the front sealing member 833 is in sliding contact with the outer circumferential surface of the contact protrusion 854 and the inner circumferential portion of the front end portion 834*a* of the rear sealing member 834 is in sliding contact with the outer circumferential surface of the cable 881, abrasion occurs easily, and the function as a seal lip is likely to deteriorate in a case of long-time use.

Here, an object of the present disclosure is to provide a highly reliable terminal sealing member capable of solving the above-described problem in the related art, having a simple configuration, being easily assembled, being produced at low cost, slidably holding a terminal while reliably maintaining fluid tightness and air tightness, and reliably maintaining a state of conduction between the terminal and a mating terminal of a mating connector, a method of producing the same, and a connector including the same.

A terminal sealing member includes: a shaft portion and a flange disposed on the shaft portion and attached to a terminal slidable in a front-rear direction; an urging member which is attached around the shaft portion and urges the flange forward; an elastic tubular member which includes a central hole into which the shaft portion is slidably inserted and has the urging member embedded therein; and an elastic adhering member which includes a central hole into which the shaft portion is slidably inserted and is attached to front and back ends of the elastic tubular member.

The elastic tubular member includes a main body portion whose outer shape is a right quadrangular prism, and a coupling portion which has a cylindrical outer shape and is integrally connected to the front and back ends of the main body portion, and an outer diameter of the coupling portion is substantially the same as a length of a diagonal line of a transverse cross-section of the main body portion.

The urging member is the coil spring, and an outer surface of the urging member comes close to a plane of an outer periphery of the main body portion.

The elastic adhering member includes a main body portion having a cylindrical outer shape and a small diameter tubular portion protruding from one end surface of the main body portion, and the small diameter tubular portion is housed in a counterbore hole formed on an end surface of the coupling portion and is inserted into the vicinity of an end portion of the coil spring.

The elastic tubular member is formed of an elastomer, and the elastic adhering member is formed of an elastomer having a hardness higher than that of the elastic tubular member.

A method of producing a terminal sealing member includes: molding an elastic adhering member which includes a main body portion having a cylindrical outer shape and a central hole by a first elastic material; setting a pair of the elastic adhering members in a posture where the elastic adhering members face each other; setting an urging member so as to be positioned between the pair of elastic adhering members; and molding an elastic tubular member which includes a central hole and has the urging member embedded therein by a second elastic material.

The urging member is a coil spring and the elastic tubular member is molded by supporting a portion of an outer peripheral surface of the coil spring.

The first elastic material is an elastomer, and the second elastic material is an elastomer having a hardness lower than that of the first elastic material.

A connector includes: a housing which has a terminal housing recess whose front and rear are defined by a front partition wall provided with a front through hole and a rear partition wall provided with a rear through hole; a terminal which includes a shaft portion, a contact portion connected to a tip of the shaft portion, a flange disposed at a boundary between the contact portion and the shaft portion, and a rear end side contact portion in a rear end vicinity portion of the shaft portion, with the contact portion being slidably inserted into the front through hole, the contact portion protruding forward from the front partition wall contacting a front mating terminal, a rear end vicinity portion of the shaft portion being slidably inserted into the rear through hole, and the rear end side contact portion protruding backward from the rear partition wall contacting a rear mating terminal; and a terminal sealing member which includes a central hole into which the shaft portion is slidably inserted, an elastic tubular member having an urging member embedded therein, a central hole into which the shaft portion is slidably inserted, and an elastic adhering member attached to front and back ends of the elastic tubular member and urges the flange forward.

The elastic adhering member attached to an front end of the elastic tubular member is pressed against the flange and seals between the flange and the terminal sealing member, and the elastic adhering member attached to the rear end of the elastic tubular member is pressed against the rear partition wall and seals between the rear partition wall and the terminal sealing member.

In a state in which the contact portion does not contact the front mating terminal, the urging member is applied with a preload and the flange is pressed against the front partition wall.

According to the present disclosure, it is possible to implement a simple configuration, allow easy assembly, achieve low cost, slidably hold a terminal while reliably maintaining fluid tightness and air tightness, reliably maintain a state of conduction between the terminal and a mating terminal of a mating connector, and improve reliability.

BRIEF DESCRIPTION OF DRAWINGS

FIGS. 1A and 1B are perspective views of a connector according to the present embodiment, in which FIG. 1A is a view of the connector viewed obliquely from the front, and FIG. 1B is a view of the connector viewed obliquely from the rear.

FIGS. 5A and 5B are perspective views of a tubular sealing member according to the present embodiment, in which FIG. 5A is a perspective view illustrating a state in which the elastic tubular member and an elastic adhering member are combined, and FIG. 5B is an exploded view of the tubular sealing member.

FIGS. 6A-6C are cross-sectional views of the tubular sealing member according to the present embodiment, in which FIG. 6A is a side cross-sectional view illustrating a state in which the elastic tubular member and the elastic adhering member are combined, FIG. 6B is a side cross-sectional view of the elastic tubular member, and FIG. 6C is a cross-sectional view taken along line A-A of FIG. 6B.

FIGS. 8A-8C are perspective views illustrating each step of a method of producing the tubular sealing member according to the present embodiment, in which FIG. 8A is a perspective view illustrating a positional relationship of front and rear elastic adhering members, FIG. 8B is a perspective view illustrating a positional relationship between the front and rear elastic adhering members and a coil spring, and FIG. 8C is a perspective view illustrating a molded tubular sealing member.

FIGS. 9A and 9B are partial cross-sectional views of a housing according to the present embodiment, in which FIG. 9A is a view of the housing viewed obliquely from the front, and FIG. 9B is a view of the housing viewed obliquely from the rear.

DETAILED DESCRIPTION OF THE PREFERRED EMBODIMENTS

An embodiment will be described in detail below with reference to the drawings.

Figure 1A:
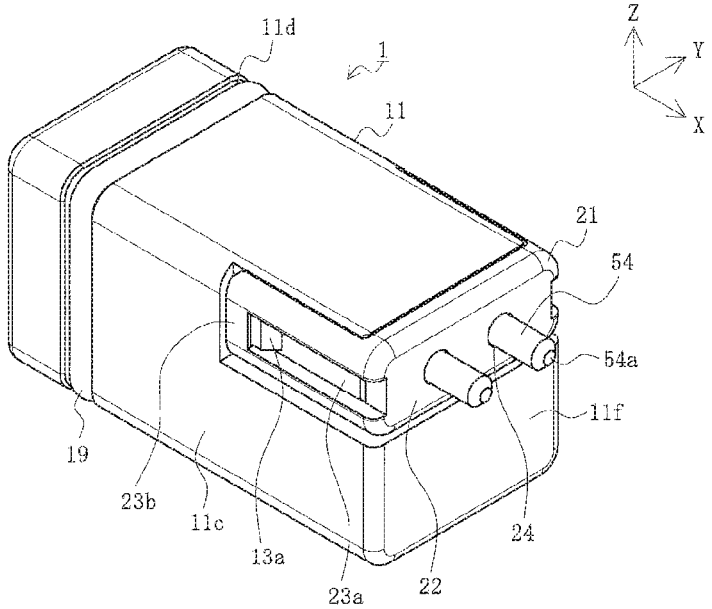
Figure 1B:
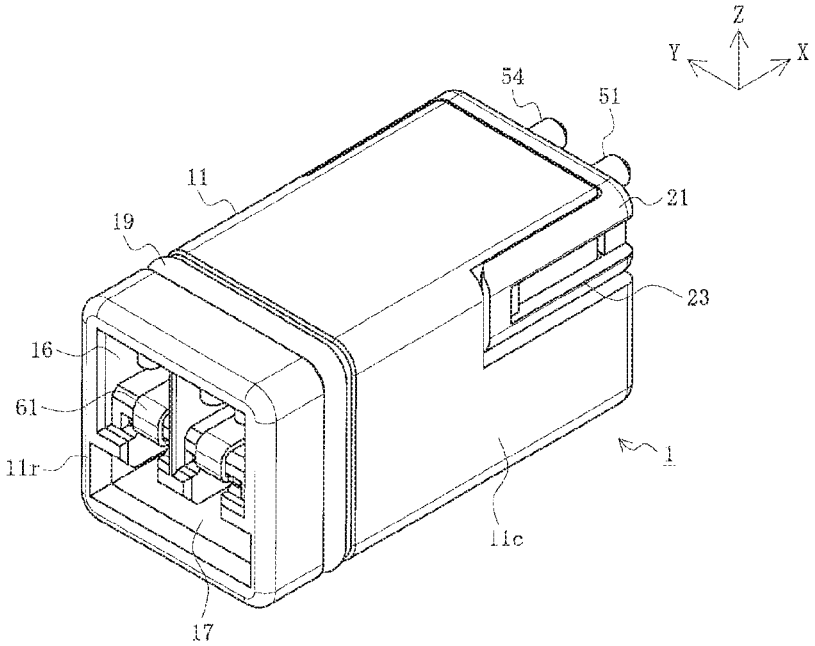
Figure 2:
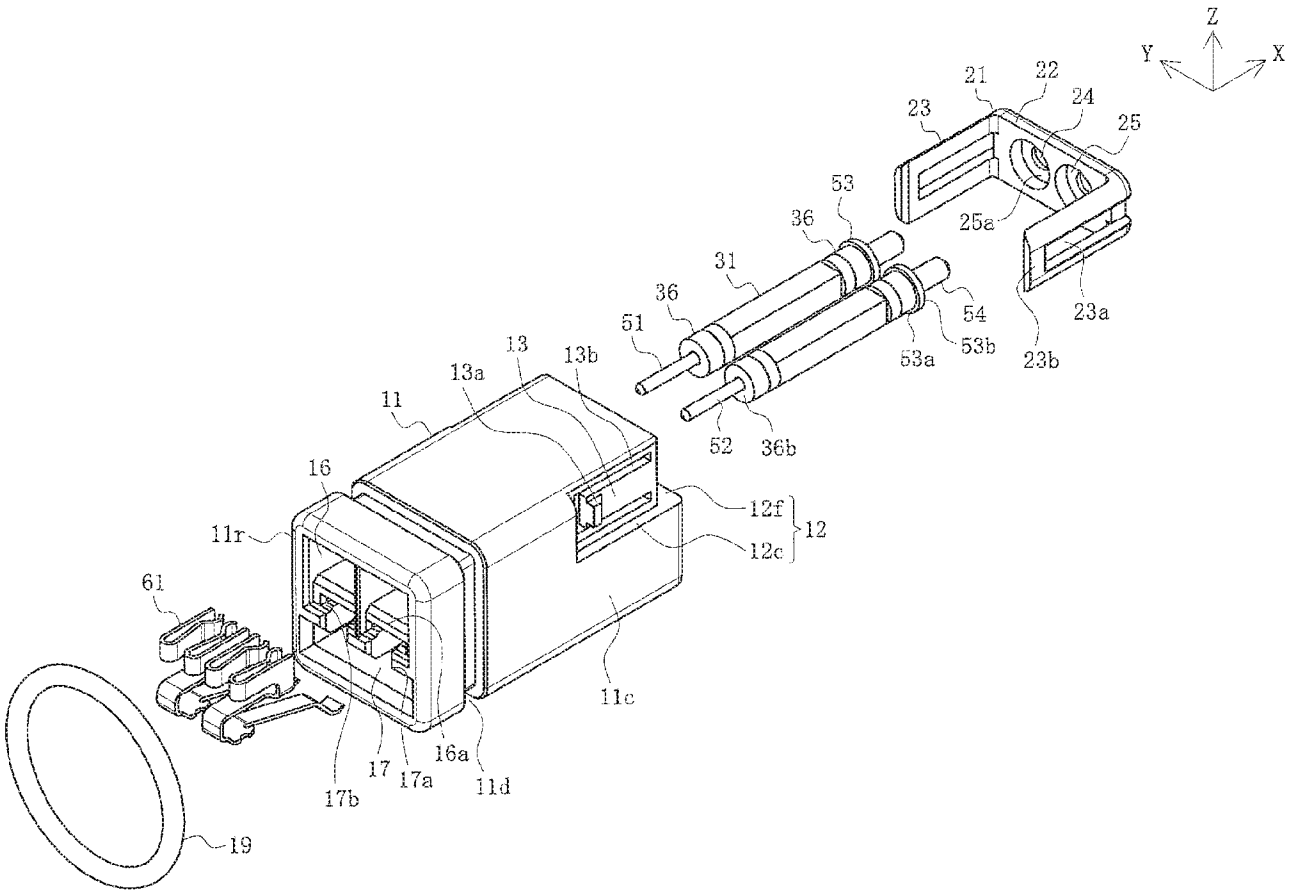
FIG. 2 is an exploded view of the connector according to the present embodiment.
Figure 3:
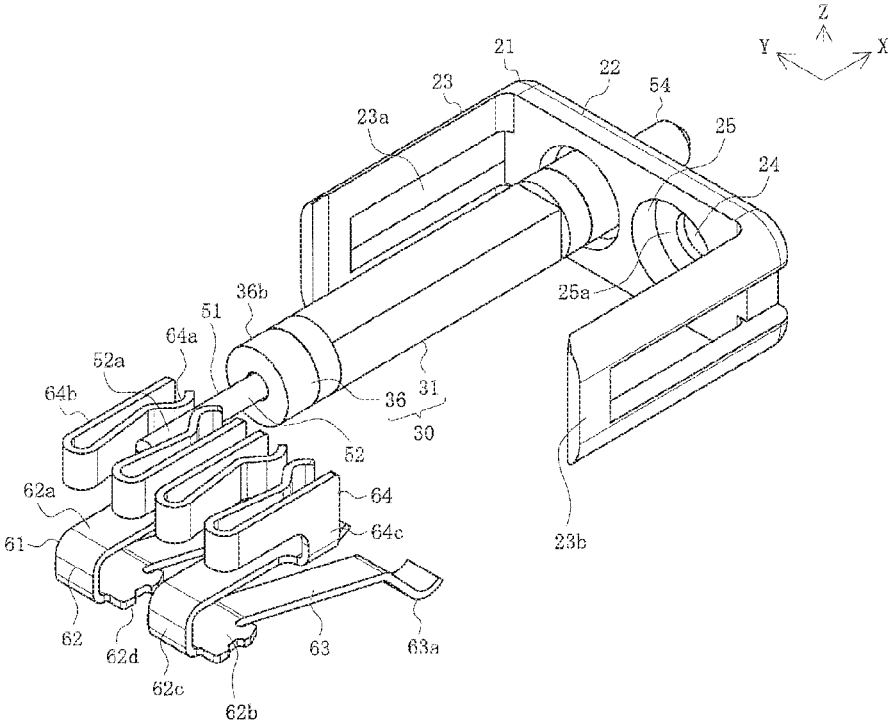
FIG. 3 is a perspective view illustrating a relationship between a terminal to which an elastic tubular member is attached, a terminal holder, and a relay terminal according to the present embodiment.
Figure 4:
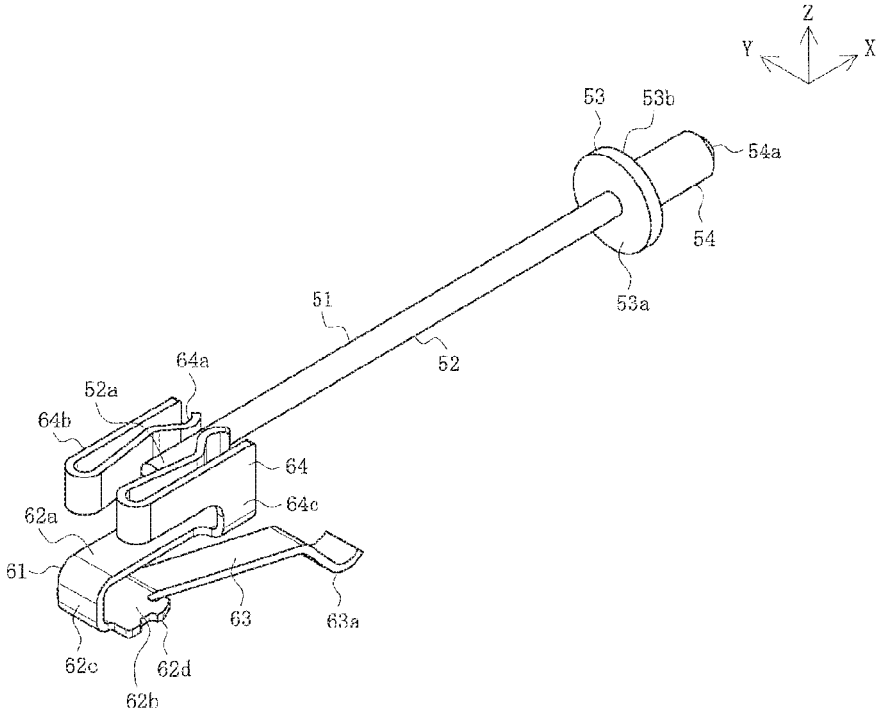
FIG. 4 is a perspective view illustrating a relationship between the terminal and the relay terminal according to the present embodiment.

FIGS. 1A and 1B are perspective views of a connector according to the present embodiment, FIG. 2 is an exploded view of the connector according to the present embodiment, FIG. 3 is a perspective view illustrating a relationship between a terminal to which an elastic tubular member is attached, a terminal holder, and a relay terminal according to the present embodiment, and FIG. 4 is a perspective view illustrating a relationship between the terminal and the relay terminal according to the present embodiment. Note that in FIGS. 1A and 1B, FIG. 1A is a view of the connector viewed obliquely from the front, and FIG. 1B is a view of the connector viewed obliquely from the rear.

In the drawings, 1 indicates a connector according to the present embodiment, and the connector 1 includes a housing 11 and a terminal 51 loaded in the housing 11. The connector 1 can be used to connect an electric power line that connects a power source (such as a battery) and a member that consumes electric power to each other in an electronic device, an electrical device, or the like. Further, the connector 1 can also be used to connect a signal line.

Note that an electronic device, an electrical device, or the like to which the connector 1 is attached may be any kind of device, but herein is a device having a size relatively small enough to be portable by a person. Further, a description will be provided under the assumption that a dimension of the connector 1 in a front-rear direction (X-axis direction) is about 1.5 [cm]. Further, although the number of the terminals 51 can be arbitrarily determined, a description will be provided herein under the assumption that there are two terminals.

Further, according to the present embodiment, expressions for indicating directions such as up, down, left, right, front, and rear, which are used to describe configurations and operations of each portion of the connector 1, are not absolute but rather are relative, and are appropriate when each portion of the connector 1 is in position as illustrated in the drawings, and the expressions should be interpreted differently in accordance with any change in the position of each portion of the connector 1.

The housing 11 is formed of an insulating material such as a resin, and in the example illustrated in the drawings, is a member having a substantially cuboid-like appearance, and a terminal holder 21 is detachably attached as a retainer formed of an insulating material such as a resin. Two terminal housing cavities 15 (to be described later) that extend in the front-rear direction (X-axis direction) are formed inside the housing 11, and each terminal 51 is housed within each terminal housing cavity 15. Further, the terminal housing cavity 15 is attached adjacent to a front surface 11*f* of the housing 11 to prevent the terminal 51 housed within each terminal housing cavity 15 from being pulled forward. Furthermore, two relay terminal housing recesses 16 that are open at a rear surface 11*r* and communicate with the terminal housing cavities 15, respectively, and two device terminal housing recesses 17 that are positioned below (Z-axis negative direction) the relay terminal housing recesses 16, respectively, and are open at the rear surface 11*r*, are formed in the housing 11. Each relay terminal housing recess 16 is partitioned from the device terminal housing recess 17 by a floor plate 16*a* that functions as a relay terminal attaching plate. Moreover, a protruding portions 17*a* extending in the front-rear direction in the device terminal housing recess 17 is formed directly below each of left and right edges of the floor plate 16*a* of each relay terminal housing recess 16, and a relay terminal holding groove 17*b* extending in the front-rear direction is formed between the protruding portion 17*a* and the floor plate 16*a*.

Note that an o-ring 19 may be mounted on the housing 11 in order to seal between the connector 1 and the device to which the connector 1 is attached. In this case, a groove portion 11*d* is formed over an entire circumference of a surface of the housing 11, and the o-ring 19 is housed in the groove portion 11*d*.

In the example illustrated in the drawings, the terminal 51 formed of a conductive material such as metal includes an elongated cylindrical shaft portion 52 extending in the front-rear direction, a cylindrical contact portion 54 extending in the front-rear direction and connected to a distal end of the shaft portion 52, and a collar-shaped flange 53 disposed at a boundary between the contact portion 54 and the shaft portion 52. Furthermore, a front end 54*a* of the contact portion 54 is a portion that comes into contact with and conducts with a mating terminal as a front mating terminal included in a mating connector (not illustrated). Note that in the example illustrated in the drawings, a portion near the front end of the contact portion 54 has a conical or frusto-conical shape, but is not necessarily limited thereto, and may have a pyramidal or hemispherical shape. Furthermore, the front end 54*a* is not limited to a corner or a flat surface, and can have various shapes such as a hemispherical shape. Furthermore, the contact portion 54 can have a leaf spring shape to have elasticity.

In the example illustrated in the drawings, an outer diameter of the contact portion 54 is larger than an outer diameter of the shaft portion 52, and an outer diameter of the flange 53 is larger than the outer diameter of the contact portion 54. The outer diameter of the shaft portion 52 is, for example, approximately 0.6 [mm], but can be changed as appropriate. Note that the terminal 51 may be integrally formed, but the shaft portion 52, the flange 53, and the contact portion 54 may each be formed separately and joined to each other by means such as screwing, welding, and adhering. Furthermore, the flange 53 need not necessarily be formed of a conductive material, and may be formed of, for example, an insulating material such as a resin. Furthermore, the flange 53 that is formed of an insulating material such as a resin, and the shaft portion 52 and the contact portion 54 that are formed of a conductive material such as metal may be integrally formed.

As illustrated in FIGS. 2 and 3, the terminal 51 is housed within the terminal housing cavity 15 of the housing 11, in a state in which the elastic tubular member 31 surrounding the shaft portion 52 is attached to the terminal 51. More specifically, the cylindrical elastic adhering member 36 surrounding the shaft portion 52 is attached so as to be positioned at each of front and back ends of the elastic tubular member 31. The elastic tubular member 31 and the elastic adhering member 36 function as a tubular sealing member 30, which is a terminal sealing member, and seal between an outer circumferential surface of the shaft portion 52 and an inner circumferential surface of the terminal housing cavity 15, in a state of being housed within the terminal housing cavity 15 of the housing 11. Furthermore, one end surface of the elastic adhering member 36 that is opposite to the other end surface of the elastic adhering member 36 that faces the elastic tubular member 31 is an adhering outer end surface 36*b* that functions as an adhering surface, and the adhering outer end surface 36*b* of the elastic adhering member 36 positioned on the front side (X-axis positive direction) adheres to a rear surface 53*a* of the flange 53. Note that an outer diameter of the elastic adhering member 36 is set to be the same as or slightly smaller than the outer diameter of the flange 53. Note that, in FIG. 3, for convenience of explanation, only one of the two terminals 51 and one of the two tubular sealing members 30 are drawn, and the other one of the two terminals 51 and the other one of the two tubular sealing members 30 are not drawn.

Furthermore, a front surface 53*b* of the flange 53 abuts the terminal holder 21, and the contact portion 54 protrudes forward from the terminal holder 21. An overall shape of the terminal holder 21 as seen from above is a substantial gate shape, and the terminal holder 21 includes a holding plate portion 22 as a front partition wall having a rectangular flat plate shape and extending in a left-right direction (Y-axis direction), and a pair of side plate portions 23 extending rearward from left and right ends of the holding plate portion 22, respectively. An opening 23*a* having a slit shape and extending in the front-rear direction is formed in each of the side plate portions 23, and a rear end of the opening 23*a* is closed by a locking piece 23*b* extending in a top-bottom direction. Further, in the holding plate portion 22, an insertion hole 24 as a front through-hole through which the contact portion 54 of each terminal 51 is inserted is formed at a position corresponding to each terminal housing cavity 15 so as to pass through the holding plate portion 22 in the front-rear direction. In addition, a recess 25 having a counterbore hole shape and housing the flange 53 is formed so as to be concentric with the insertion hole 24 at the periphery of each insertion hole 24 in a rear surface of the holding plate portion 22, and a bottom surface portion 25*a* of the recess 25 functions as a stopper wall against which the front surface 53*b* of the flange 53 abuts. Forward displacement of the terminal 51 is restricted by the front face 53*b* of the flange 53 abutting the bottom surface portion 25*a*. Note that the recess 25 may be omitted so that the front surface 53*b* of the flange 53 abuts a flat rear surface of the holding plate portion 22.

Note that a front recess 12*f* is formed in the front surface 11*f* of the housing 11 and side recesses 12*c* are formed in left and right side surfaces 11*c* of the housing 11, respectively. The left and right side recesses 12*c* are connected to left and right ends of the front recess 12*f*, respectively, thereby forming a terminal holder housing recess 12 of which an overall shape as seen from above is a substantial gate shape. Furthermore, a cantilevered locking plate 13 having a proximal end integrally connected to the housing 11 and a distal end (free end) extending rearward is formed in each side recess 12*c*, and a locking protrusion portion 13*a* protruding outward in a width direction of the housing 11 is formed near the free end of the locking plate 13. Note that an elongated cut portion 13*b* is formed in the periphery of the locking plate 13, and the locking plate 13 functions as a leaf spring of which a portion other than the proximal end is separated from the housing 11 and is elastically displaceable in the width direction of the housing 11, by the cut portion 13*b*.

Further, as illustrated in FIGS. 1A and 1B, when the terminal holder 21 is housed in the terminal holder housing recess 12 and attached to the housing 11, the holding plate portion 22 is housed in the front recess 12*f*, the left and right side plate portions 23 are housed in the left and right side recesses 12*c*, respectively, and the locking protrusion portion 13*a* is housed in the opening 23*a* of the side plate portion 23 and engages with the locking piece 23*b*. As a result, the terminal holder 21 is attached to the housing 11 and is locked and is prevented from being detached from the housing 11. Further, the contact portion 54 of the terminal 51 protrudes forward from the holding plate portion 22 as illustrated in FIGS. 1A and 1B. In addition, since the flange 53 abuts the holding plate portion 22, the terminal 51 housed in the terminal housing cavity 15 is reliably prevented from being pulled forward.

Note that it is preferable that a front surface of the holding plate portion 22 is substantially flush with the front surface 11*f* of the housing 11, and an outer surface of the side plate portion 23 is substantially flush with the side surface 11*c* of the housing 11 in a state in which the terminal holder 21 is housed in the terminal holder housing recess 12 and attached to the housing 11. Further, in the example illustrated in the drawings, the terminal holder 21 is housed in the terminal holder housing recess 12 formed in the housing 11 and attached to the housing 11, but it is not necessary to form a recess like the terminal holder housing recess 12 in the housing 11, and a member with other forms such as a guide rib may be formed in the housing 11.

Furthermore, the shaft portion 52 of the terminal 51 protrudes rearward from the adhering outer end surface 36*b* of the elastic adhering member 36 positioned on the rear side (X-axis negative direction). Further, in a state in which the terminal 51 is housed in the terminal housing cavity 15 together with the elastic tubular member 31 and the elastic adhering member 36, a portion near a rear end of the shaft portion 52 enters into the relay terminal housing recess 16 behind the terminal housing cavity 15 and functions as a rear end side contact portion 52*a* coming into contact with a relay terminal 61 as a rear mating terminal disposed inside the relay terminal housing recess 16. The rear end side contact portion 52*a* need not necessarily have the same outer diameter as that of other portions of the shaft portion 52, and a boundary between the rear end side contact portion 52*a* and the other portions of the shaft portion 52 may not be clear. Furthermore, the flange 53 and the contact portion 54 need not necessarily have a circular transverse cross-section, but may have a polygonal transverse cross-section, and the flange 53 and the contact portion 54 need not necessarily be positioned coaxially. Note that, in FIG. 4, for convenience of explanation, only one of the two terminals 51 and one of the two relay terminals 61 are drawn, and the other one of the two terminals 51 and the other one of the two relay terminals 61 are not drawn.

In the example illustrated in the drawings, the relay terminal 61 is a member integrally formed by performing a bending process on a conductive metal plate, and includes a main body piece 62 having a side surface with a substantial "J"-letter shape, a cantilevered device terminal contact piece 63 having a proximal end connected to the main body piece 62, and a pair of left and right terminal contact pieces 64. The main body piece 62 includes an elongated band-like upper piece 62*a* extending in the front-rear direction, a curved piece 62*c* extending downward from a rear end of the upper piece 62*a* and curved by approximately 180 degrees so that a front end of the curved piece 62*c* faces forward, and a fixing piece 62*b* connected to a distal end of the curved piece 62*c* and having left and right sides on which rugged anchor portions 62*d* are formed. Furthermore, the device terminal contact piece 63 is an elongated leaf spring that is inclined so that a proximal end thereof is connected to a distal end of the fixing piece 62*b* and a distal end thereof faces obliquely downward, and a device terminal contact portion 63*a* that is curved so as to bulge downward is formed on the distal end of the device terminal contact piece 63. Furthermore, each terminal contact piece 64 includes a connecting leg piece 64*c* extending upward from a side edge near a front end of the upper piece 62*a*, a curved contact arm piece 64*b* that has a proximal end connected to an upper end of the connecting leg piece 64*c* and is bent so as to have a substantial "U"-letter shape as seen from above, and a terminal contact portion 64*a* formed on a distal end (free end) of the contact arm piece 64*b* and curved so as to bulge toward another contact arm piece 64*b*. Moreover, in each relay terminal 61, the pair of terminal contact pieces 64 is configured to be left-right symmetrical with respect to an X-Z plane passing through the center of the upper piece 62*a* in the width direction. Note that a position of the terminal contact portion 64*a* in the front-rear direction is close to the front end of the upper piece 62*a*.

Further, the relay terminal 61 is inserted into the relay terminal housing recess 16 and the device terminal housing recess 17 that are open at the rear surface 11*r* from behind the housing 11 to be housed in the relay terminal housing recess 16 and the device terminal housing recess 17. Specifically, the upper piece 62*a* of the main body piece 62 and the pair of left and right terminal contact pieces 64 connected to the upper piece 62*a* are inserted into the relay terminal housing recess 16, and the fixing piece 62*b* of the main body piece 62 and the device terminal contact piece 63 are inserted into the device terminal housing recess 17. Furthermore, the curved piece 62*c* abuts or comes close to a rear end of the floor plate 16*a*, and the floor plate 16*a* is vertically sandwiched by the upper piece 62*a* and the fixing piece 62*b*, such that the relay terminal 61 is stably attached to the housing 11. Furthermore, since a portion near each of the left and right ends of the fixing piece 62*b* is inserted into the relay terminal holding groove 17*b* in the device terminal housing recess 17, and the anchor portion 62*d* formed on each of the left and right ends of the fixing piece 62*b* bites into a side wall of the relay terminal holding groove 17*b*, the relay terminal 61 is reliably fixed to the housing 11 and is prevented from being pulled rearward.

As described above, in a state in which each relay terminal 61 is attached to the housing 11, the rear end side contact portion 52*a* of the shaft portion 52 of the corresponding terminal 51 that enters into the relay terminal housing recess 16 behind the terminal housing cavity 15 enters between the terminal contact portions 64*a* of the pair of left and right terminal contact pieces 64 connected to each upper piece 62*a*, the terminal contact portions 64*a* facing each other. Furthermore, the rear end side contact portion 52*a* is elastically and horizontally sandwiched by the terminal contact portions 64*a* facing each other due to springiness exhibited by the contact arm 64*b*. Therefore, even when the terminal 51 is displaced in the front-rear direction, a state of conduction between the terminal 51 and the relay terminal 61 is stably maintained, because the rear end side contact portion 52*a* is in sliding contact with the terminal contact portion 64*a* while maintaining the contact with the terminal contact portion 64*a*. Furthermore, the left and right terminal contact pieces 64 are left-right symmetrical with respect to the X-Z plane passing through the center of the upper piece 62*a* in the width direction, and thus the shaft portion 52 of the terminal 51 can be positioned in the left-right direction by horizontally sandwiching the rear end side contact portion 52*a* between the left and right terminal contact portions 64*a*. As a result, the shaft portion 52, for example, may not run into a communication hole 15*b* penetrating through a cavity-recess partition wall 16*b* to be described later in a state in which the shaft portion 52 is misaligned with the communication hole 15*b*, such that sliding resistance when moving in the front-rear direction is reduced.

Note that a device terminal, which is a terminal provided in a device (not illustrated) to which the connector 1 is attached, is inserted into the device terminal housing recess 17 from behind the housing 11 and comes into contact with the device terminal contact portion 63*a* of the device terminal contact piece 63. As a result, the device terminal and the terminal 51 conduct with each other via the relay terminal 61.

Next, the configuration of the tubular sealing member 30 will be described in detail.

Figure 5A:
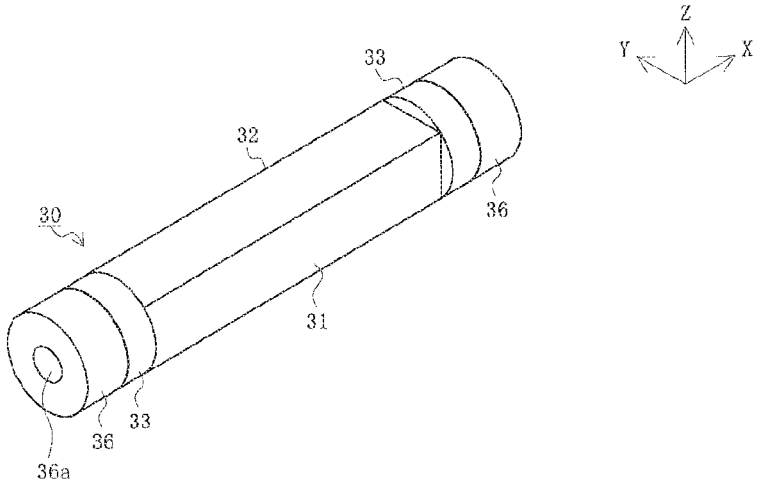
Figure 5B:
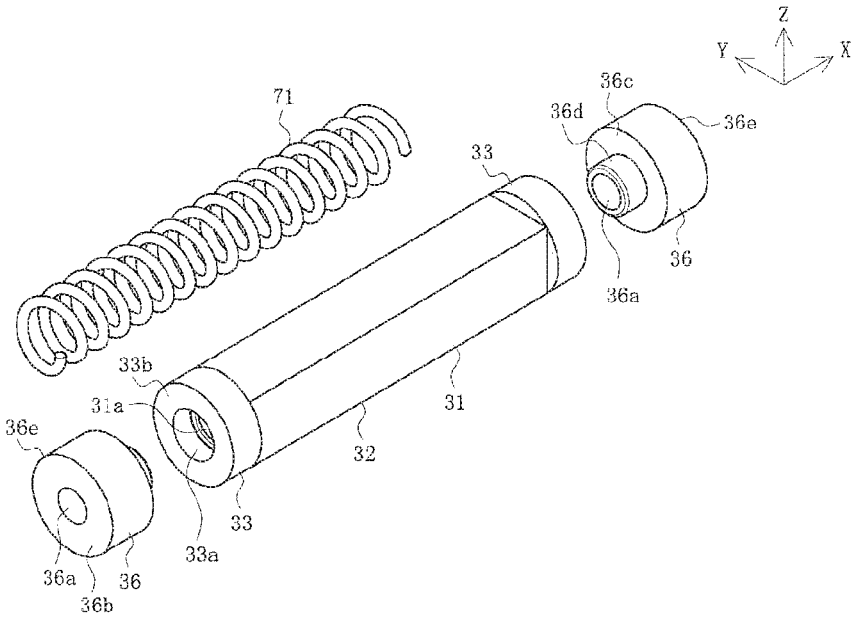
Figure 6A:
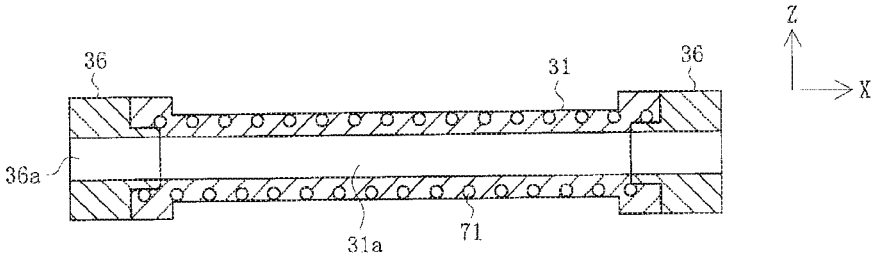
Figure 6B:
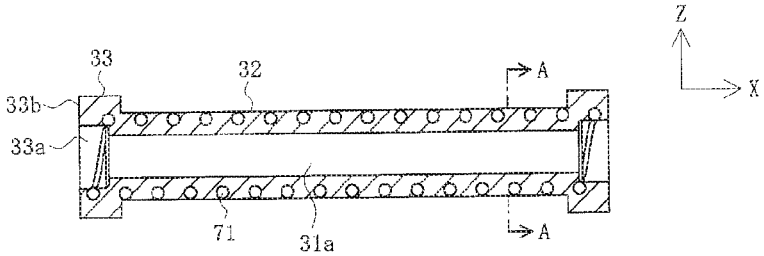
Figure 6C:
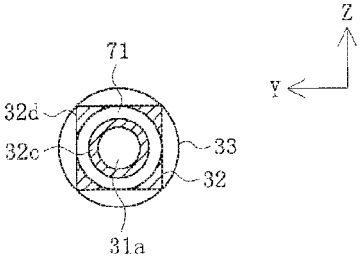
Figure 7:
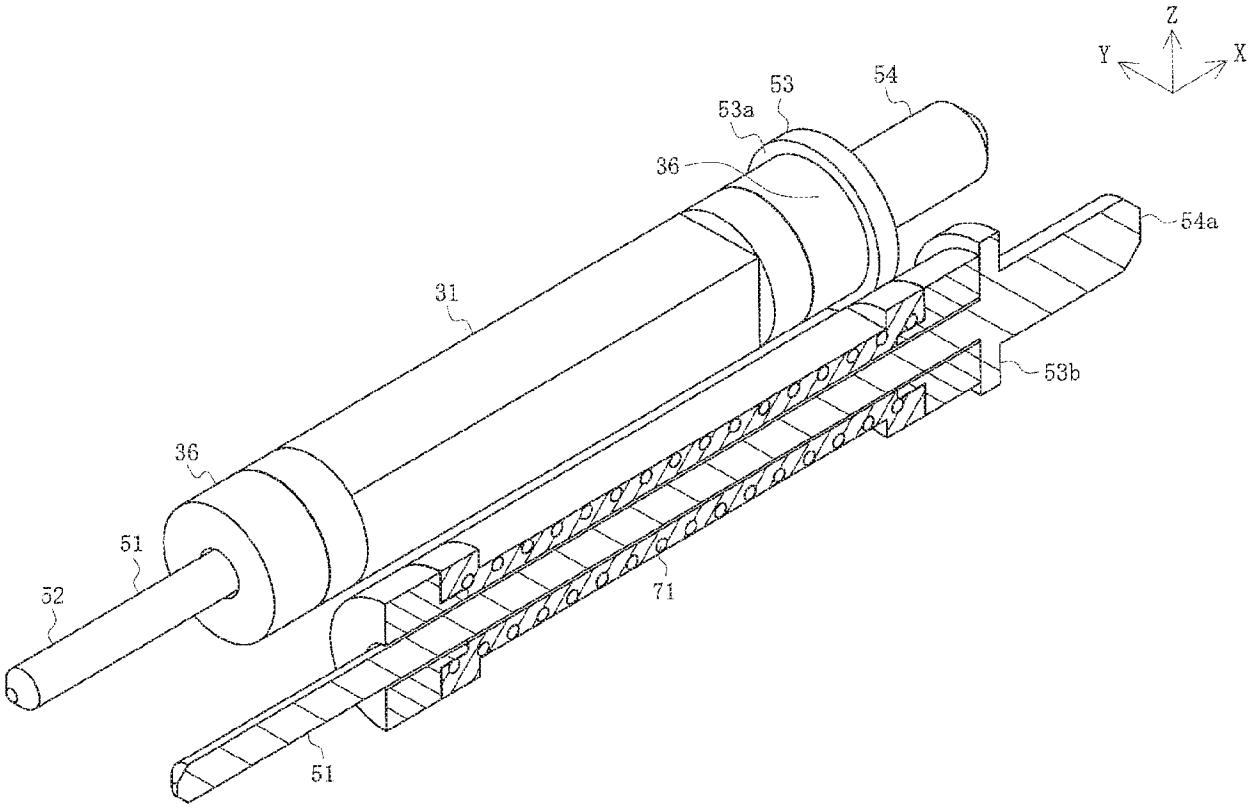
FIG. 7 is a perspective view of the terminal to which the tubular sealing member is attached according to the present embodiment.

FIGS. 5A and 5B are perspective views of the tubular sealing member in the present embodiment, FIGS. 6A-6C are cross-sectional views of the tubular sealing member in the present embodiment, and FIG. 7 is a perspective view of a terminal to which the tubular sealing member is attached in the present embodiment. Note that in FIGS. 5A and 5B, FIG. 5A is a perspective view of a state in which an elastic tubular member and an elastic adhering member are combined, FIG. 5B is an exploded view of the tubular sealing member, and in FIGS. 6A-6C, FIG. 6A is a side cross-sectional view in a state in which the elastic tubular member and the elastic adhesive member are combined, FIG. 6B is a side cross-sectional view of the elastic tubular member, and FIG. 6C is a side cross-sectional view taken along the line A-A in FIG. 6B.

In the present embodiment, the elastic tubular member 31 includes an elongated main body portion 32 that has a prismatic outer shape, and a short coupling portion 33 that is integrally connected to both ends of the main body portion 32 in a longitudinal direction (X-axis direction) and has a cylindrical outer shape. The outer shape of the main body portion 32 is a right quadrangular prism having a substantially squared cross section, and the outer shape of the coupling portion 33 is a circular column having a circular cross section, in which a diameter of the coupling portion 33 is substantially the same as a diagonal length of the square. In addition, as illustrated in FIGS. 6A-6C, the elastic tubular member 31 is formed with a central hole 31*a* extending in a longitudinal direction along a central axis thereof. The central hole 31*a* is a through hole having a circular cross section and a constant inner diameter, and has a shaft portion 52 of a terminal 51 housed therein, in which the through hole passes through the main body portion 32 and the coupling portions 33 on both sides thereof and extends over the entire length of the elastic tubular member 31. The coupling portion 33 is formed with a counterbore hole 33*a* so that the counterbore hole 33*a* extends from the end surface 33*b* thereof toward a center of the elastic tubular member 31 in the longitudinal direction. The counterbore hole 33*a* is a portion that functions as a coupling recess in which a small diameter tubular portion 36*d* of the elastic adhering member 36 is housed, and shares a central axis with the central hole 31*a*, but has an inner diameter larger than an inner diameter of the central hole 31*a* and a depth (dimension in the X-axis direction) smaller than a length (dimension in the X-axis direction) of the coupling portion 33.

Furthermore, the elastic tubular member 31 is a member formed of an insulating elastic material such as elastomer, and has a coil spring 71 as an urging member provided therein. Specifically, the coil spring 71 formed of metal and the elastic tubular member 31 formed of elastomer are integrated by overmolding (insert molding), and the coil spring 71 is embedded in the elastic tubular member 31 as illustrated in FIGS. 6A-6C and 7. Note that in FIG. 5B, for convenience of explanation, the coil spring 71 is drawn in a state of being separated from the elastic tubular member 31. The dimension of the elastic tubular member 31 are, for example, a length of about 9.0 [mm] in a front-rear direction, an outer diameter of about 1.7 [mm], and the inner diameter of the central hole 31*a* of about 0.8 [mm], which may be changed as appropriate. Note that the length of the elastic tubular member 31 in the front-rear direction is set to be shorter than the length of the shaft portion 52 in the front-rear direction. The elastomer as the material of the elastic tubular member 31 is not limited to TPEs (thermoplastic elastomer) such as styrene-based TPE and olefin-based TPE, but may be thermosetting elastomer such as rubber.

Thus, the elastic tubular member 31 formed of elastomer is integrated with the coil spring 71 formed of metal, and therefore looks like having a metal core and becomes a member that is solid and has a stable shape. Further, spring properties of the entire elastic tubular member 31 can be improved, and buckling such as bending can be prevented.

Further, as illustrated in FIGS. 6A-6C, the coil spring 71 is not exposed to the outside of the elastic tubular member 31, that is, any of at least an outer circumferential surface of the coupling portion 33 whose outer shape is cylindrical, the end surface 33*b* of the coupling portion 33, an inner surface of the central hole 31*a*, and an inner surface of counterbore hole 33*a* are not exposed. Note that the coil spring 71 may be exposed on the inner surface of the counterbore hole 33*a*.

In the example shown in FIGS. 6A-6C, the coil spring 71 is formed so that an outer diameter of the coil spring 71 is slightly smaller than a length of one side of the main body portion 32 whose outer shape is a square in a transverse cross-section, and is formed to be close to four planes on the outer circumferential surface of the main body portion 32. That is, when viewed from the front or rear of the elastic tubular member 31, the outer periphery of the coil spring 71 is an inscribed circle of the outer circumferential surface of the squared main body portion 32. Thus, since the coil spring 71 comes close to the plane of the outer circumferential surface of the main body portion 32, whose a transverse cross-section is square, of the elastic tubular member 31, the outer circumferential surface of the coil spring 71 can be supported by an inner circumferential surface of a mold cavity for molding the elastic tubular member 31. In this case, a portion of the outer circumferential surface of the coil spring 71 may be exposed on the outer circumferential surface of the prismatic main body portion 32, but an inner circumferential surface of the coil spring 71 is not exposed, so the elastomer which is the material of the main body portion 32 is continuously formed inside the coil spring 71. In addition, the inner diameter of the coil spring 71 is formed to be slightly larger than an inner diameter of the counterbore hole 33*a*, that is, an outer diameter of the small diameter tubular portion 36*d* of the elastic adhering member 36, and comes close to an inner circumferential surface of the counterbore hole 33*a*. Further, since the inner diameter of the coil spring 71 is larger than the inner diameter of the central hole 31*a*, the coil spring 71 is separated from an inner circumferential surface of the central hole 31*a*. Thereby, the main body portion 32 of the elastic tubular member 31 is continuously formed inside the coil spring 71 with a predetermined thickness.

Therefore, as illustrated in FIG. 6C, the main body portion 32 of the elastic tubular member 31 includes an inner portion 32*c* and an outer portion 32*d*, and the elastomer on both sides of an inner side and an outer side of the coil spring 71, that is, the elastomer on the inner portion 32*c* and the outer portion 32*d* is uniformly restored to an original length by a spring force of the coil spring 71, so it is possible to prevent flatness of an end surface 33*b* of the coupling portion 33 that is an end surface of the elastic tubular member 31 from being lowered. Note that in order to dispose the elastomer as evenly as possible on both of the inner portion 32*c* and the outer portion 32*d*, for example, a volume (corresponding to an area in FIG. 6C) of the elastomer of the inner portion 32*c* and the outer portion 32*d* can be made equal.

In the present embodiment, the elastic adhering member 36 has a main body portion 36*e* whose outer shape is cylindrical, in which an outer diameter of the main body portion 36*e* is substantially the same as an outer diameter of the coupling portion 33. Further, a close contact outer end surface 36*b* which is one end surface of the main body portion 36*e* is flat, but the small diameter tubular portion 36*d* protrudes from a close contact inner end surface 36*c* which is the other end surface thereof. The elastic adhering member 36 is formed with a central hole 36*a* extending in the longitudinal direction along a central axis thereof. The central hole 36*a* is a through hole having a circular cross section whose inner diameter is constant, in which the through hole extends over the entire of the elastic adhering member 36 in the front-rear direction, that is, extends from the close contact outer end surface 36*b* to the small diameter tubular portion 36*d*. Further, the inner diameter of the central hole 36*a* is substantially the same as the inner diameter of the central hole 31*a* of the elastic tubular member 31, the outer diameter of the small diameter tubular portion 36*d* is the same as or slightly smaller than the inner diameter of the counterbore hole 33*a* of the elastic tubular member 31, a protruding amount (dimension in the X-axis direction) from the close contact inner end surface 36*c* of the small diameter tubular portion 36*d* is the same as or slightly smaller than a depth of the counterbore hole 33*a*. Further, it is desirable that the outer diameter of the main body portion 36*e*, at least the outer diameter of the contact outer end surface 36*b*, is the same as or slightly smaller than an outer diameter of a flange 53. As a result, the adhesion between the close contact outer end surface 36*b* and a rear surface 53*a* of the flange 53 is improved, and the sealing performance is improved. Further, the elastic adhering member 36 is a member formed of an elastic material such as elastomer, and is preferably formed of an insulating elastic material having a hardness higher than that of the elastic tubular member 31, for example, a TPE (thermoplastic elastomer) having a hardness of 70. Note that the inside of the elastic adhering member 36 is not provided with the coil spring 71 or other members.

As illustrated in FIGS. 5A and 6B, the elastic adhering members 36 are each attached to front and back ends of the elastic tubular member 31, the close contact inner end surfaces 36*c* of each elastic adhering member 36 abuts the end surfaces 33*b* of the coupling portion 33 at the front and back ends of the elastic tubular member 31, and each small diameter tubular portion 36*d* enters each counterbore hole 33*a*, thereby becoming the tubular sealing member 30, and furthermore the central hole 31*a* of the elastic tubular member 31 and the central hole 36*a* of the elastic adhering member 36 become central holes of the tubular sealing member 30 which is one continuous through hole. Note that the end surface 33*b* of the coupling portion 33 and/or the close contact inner end surface 36*c* of the elastic adhering member 36 do not necessarily need to be a flat surface, and may be roughened to improve the adhesion. In addition, the total length of the coil spring 71 is shorter than the total length of the elastic tubular member 31, but is longer than the central hole 31*a*, and the front end and the rear end of the coil spring 71 are close to the inner circumferential surface of the counterbore hole 33*a*. Therefore, when the elastic adhering member 36 is attached to the front and back ends of the elastic tubular member 31, it looks as if the small diameter tubular portion 36*d* of the elastic adhering member 36 is inserted in the vicinity of the front end and the rear end of the coil spring 71. As a result, the vicinity of the front end and the vicinity of the rear end of the coil spring 71 are supported by the small diameter tubular portion 36*d* of the elastic adhering member 36.

Note that the elastic adhering member 36 may be bonded to the front and back ends of the elastic tubular member 31 by thermal bonding means such as thermocompression bonding, or may be integrated with the elastic tubular member 31 by insert molding or two-color molding. Also, the front elastic adhering member 36 and the rear elastic adhering member 36 do not necessarily have the same shape, and may have different shapes. Further, the close contact outer end surface 36*b* does not necessarily have to be a flat surface as long as it can exhibit the sealing performance, and for example, may also be a surface including an annular bulged portion having a semicircular cross section such as a donut surface.

As illustrated in FIG. 7, the terminal 51 and the tubular sealing member 30 are combined so that the shaft portion 52 is housed in the central hole 31*a* of the elastic tubular member 31 and the central hole 36*a* of the elastic adhering member 36, the flange 53 and a contact portion 54 are disposed in front of the close contact outer end surface 36*b* of the front elastic adhering member 36, and a rear end side contact portion 52*a* of the shaft portion 52 protrudes behind the close contact outer end surface 36*b* of the rear elastic adhering member 36. In addition, since an outer diameter of the shaft portion 52 is set smaller than the inner diameters of the central hole 31*a* of the elastic tubular member 31 and the central hole 36*a* of the elastic adhering member 36, the shaft portion 52 can smoothly slide with respect to the tubular sealing member 30. Note that in FIG. 7, for convenience of explanation, one of the two terminals 51 and the tubular sealing member 30 is drawn as a partial cross-sectional view illustrating a vertical cross section.

Next, an example of a method for producing a tubular sealing member 30 will be described. Note that the producing method described below is only an example, and can be changed as appropriate.

Figure 8A:
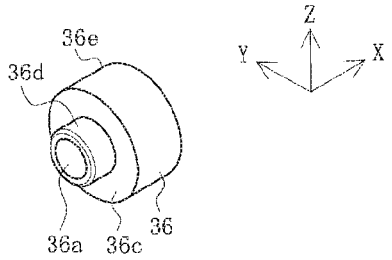
Figure 8B:
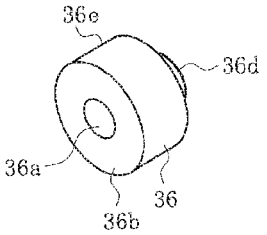
Figure 8B:
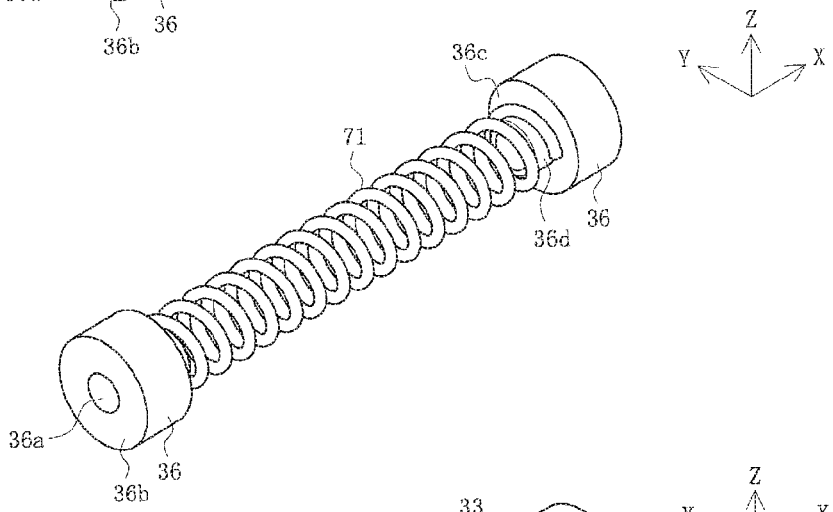
Figure 8C:
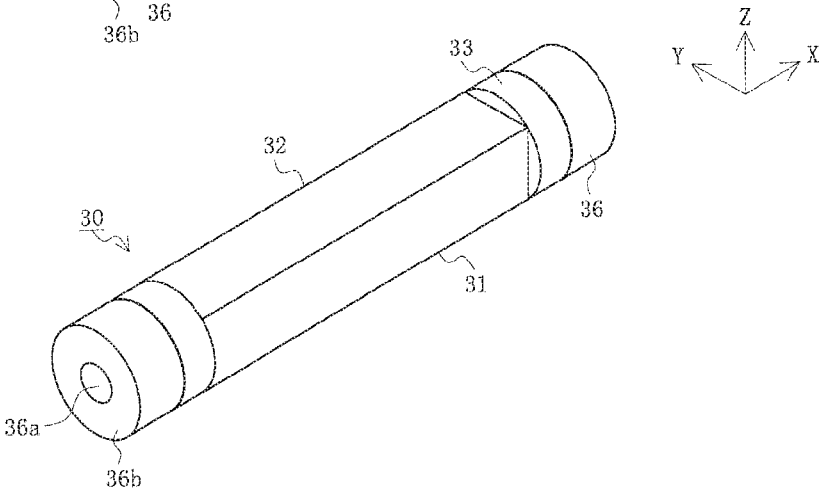

FIGS. 8A-8C are perspective views illustrating each step of a method of producing the tubular sealing member according to the present embodiment. Note that FIGS. 8A-8C, FIG. 8A is a perspective view illustrating a positional relationship between the front and rear elastic adhering members, FIG. 8B is a perspective view illustrating a positional relationship between the front and rear elastic adhering members and a coil spring, and FIG. 8C is a perspective view illustrating a molded tubular sealing member.

First, a first mold (not shown) for molding the elastic adhering member 36 is filled with an insulating elastic material, for example, TPE having a hardness of 70 by injection molding, and a pair of the front and rear elastic adhering members 36 as illustrated in FIG. 8A can be obtained.

Subsequently, a pair of the front and rear elastic adhering members 36 are set in a second mold (not shown) for molding the tubular sealing member 30 in a posture as illustrated in FIG. 8A, that is, a posture where the small diameter tubular portions 36*d* faces each other.

Subsequently, as illustrated in FIG. 8B, the coil spring 71 is combined with a pair of the front and rear elastic adhering members 36, and the small diameter tubular portion 36*d* of the elastic adhering member 36 is inserted in the vicinity of the front end and the rear end of the coil spring 71. Note that a third mold having a round bar shape (not shown) for forming the central hole 31*a* of the elastic tubular member 31 is inserted into the coil spring 71. The third mold is also inserted into the central hole 36*a* of the elastic adhering member 36. In addition, a distance between the front and rear elastic adhering members 36 is a distance at which the coil spring 71 is not compressed.

Subsequently, the second mold is closed. As a result, the mold surface forming the flat surface on the outer circumferential surface of the squared main body portion 32 of the elastic tubular member 31 can support a portion of the outer circumferential surface of the coil spring 71.

Subsequently, the second mold is filled with the insulating elastic material, for example, TPE having a hardness of 20 by the injection molding, and as illustrated in FIG. 8C, the tubular sealing member 30 in which the elastic tubular member 31, the elastic adhering member 36, and the coil spring 71 are integrated can be obtained.

The tubular sealing member 30 manufactured in this way is a member having sealing properties because the elastic tubular member 31, the elastic adhering member 36, and the coil spring 71 are integrated.

Next, a state in which the combined terminal 51 and tubular sealing member 30 are attached to the housing 11 will be described.

Figure 9A:
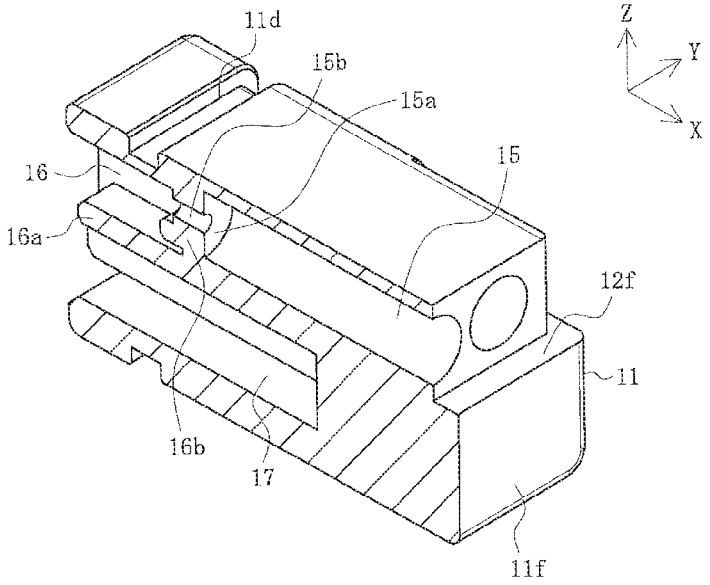
Figure 9B:
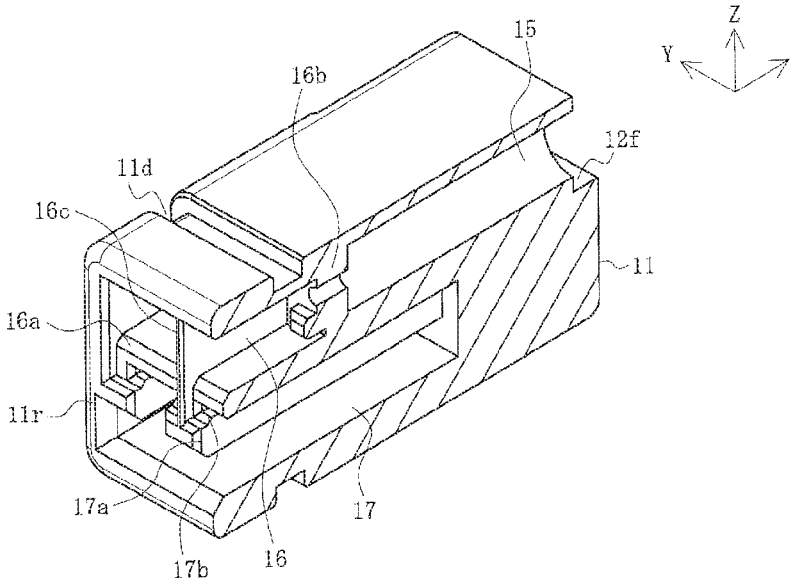
Figure 10:
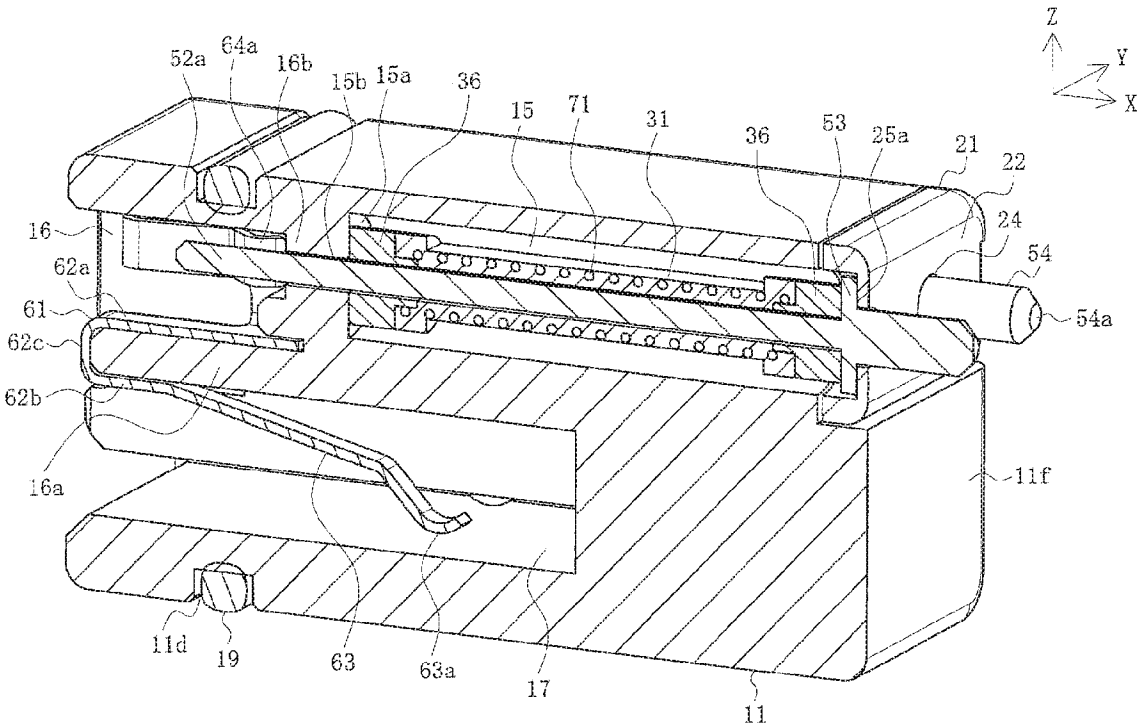
FIG. 10 is a partial cross-sectional view of the connector according to the present embodiment.
Figure 11:
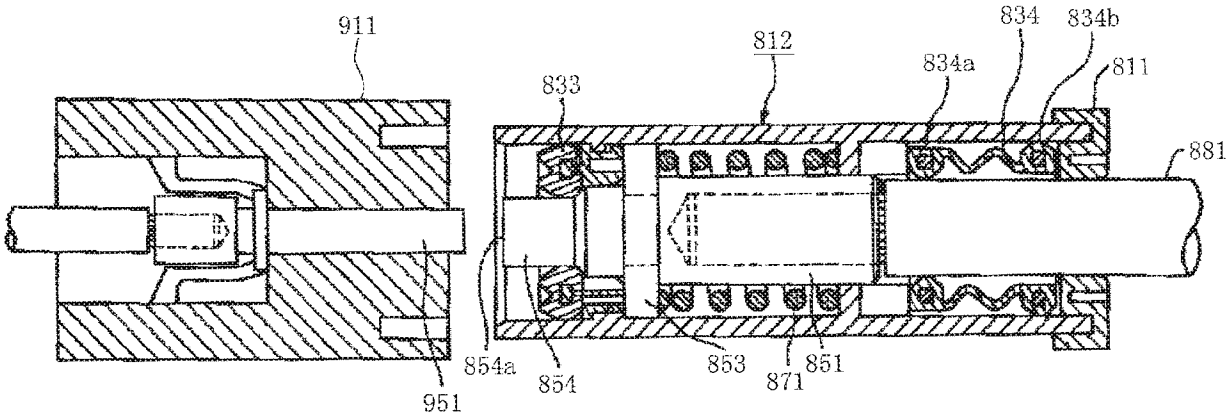
FIG. 11 Prior Art
FIG. 11 is a cross-sectional view of a connector according to the related art.

FIGS. 9A and 9B are partial cross-sectional views of the housing in the present embodiment, and FIG. 10 is a partial cross-sectional view of a connector in the present embodiment. Note that in FIGS. 9A and 9B, FIG. 9A is a diagram viewed from diagonally forward, and FIG. 9B is a diagram viewed from diagonally backward.

As illustrated in FIGS. 9A and 9B, in the housing 11, each of a pair of terminal housing cavities 15 arranged side by side and a relay terminal housing recess 16 corresponding to each terminal housing cavity 15 are partitioned by a cavity-recess partition wall 16*b* as a rear partition wall. Note that the left and right relay terminal housing recesses 16 are partitioned by a partition wall 16*c*. Each cavity-recess partition wall 16*b* is formed with a communication hole 15*b*, as a rear through hole, which extends in a front-rear direction and penetrates through the cavity-recess partition wall 16*b*, and each terminal housing cavity 15 communicates with the relay terminal housing recesses 16 corresponding thereto through the communication hole 15*b*. Note that a device terminal housing recess 17 formed under the relay terminal housing recess 16 opens only on a rear surface 11*r* of the housing 11, and does not communicate with a front surface 11*f* or a side surface 11*c* thereof. That is, the rear surface 11*r* side and the front surface 11*f* side of the housing 11 communicate with each other only through the communication hole 15*b* between the terminal housing cavity 15 and the relay terminal housing recess 16.

Both the terminal housing cavity 15 and the communication hole 15*b* are holes extending in a front-rear direction and having a circular cross section, but an inner diameter of the terminal housing cavity 15 is substantially the same as an inner diameter of a recess 25 formed in a holding plate portion 22 of a terminal holder 21, while an inner diameter of the communication hole 15*b* is smaller than an inner diameter of the terminal housing cavity 15 and slightly larger than an outer diameter of the shaft portion 52 of the terminal 51. As a result, the terminal 51 can be prevented from swinging, rattling, or the like in a direction other than the front-rear direction. Note that the surface of the terminal housing recess 15 side of the cavity-recess partition wall 16*b* is the bottom surface 15*a* of the terminal housing cavity 15 perpendicular to the axial direction (X-axis direction) of the terminal housing cavity 15, and is flat surface with which the close contact outer end surface 36*b* of the elastic adhering member 36 positioned on the rear side (X-axis load direction side) is in close contact. In addition, a length of the terminal housing cavity 15 in a front-rear direction, that is, a length from an opening of the terminal housing cavity 15 in a front recess 12*f* of the housing 11 to the bottom surface 15*a* is set to be shorter than the length of the tubular sealing member 30 in which as illustrated in FIGS. 5A and 6A, the elastic adhering member 36 is attached to the front and back ends of the elastic tubular member 31.

As illustrated in FIG. 7, the terminal 51 combined with the tubular sealing member 30 is inserted into and housed in the terminal housing cavity 15 which opens from the front to the front recess 12*f* of the housing 11 in a posture in which the rear end side contact portion 52*a* of the shaft portion 52 faces backward. Note that as illustrated in FIG. 10, since the inner diameter of the terminal housing cavity 15 is set larger than the outer diameter of the tubular sealing member 30, the terminal 51 combined with the tubular sealing member 30 can be easily inserted into and housed in the terminal housing cavity 15, and the elastic tubular member 31 can smoothly slide in the terminal housing cavity 15. At that time, the portion of the shaft portion 52 that protrudes backward of the close contact outer end surface 36*b* of the rear elastic contact member 36 is inserted into the communication hole 15*b* formed in the cavity-recess partition wall 16*b*, and the rear end side contact portion 52*a* enters the relay terminal housing recess 16. In the relay terminal housing recess 16, the rear end side contact portion 52*a* enters between the opposing terminal contact portions 64*a* of the relay terminal 61 which are attached to the housing 11 in advance and face each other, and is elastically sandwiched from the left and right by the contact portions 64*a* facing each other due to spring properties that a contact arm piece 64*b* exhibits. Note that the relay terminal 61 may be attached to the housing 11 after the terminal 51 is combined with the tubular sealing member 30 is housed in the terminal housing cavity 15, but the case where the relay terminal 61 is attached to the housing 11 in advance will be described here.

Subsequently, the terminal holder 21 is attached to the housing 11 from the front. Specifically, as illustrated in FIG. 2, the holding plate portion 22 and the side plate portion 23 relatively move backward with respect to the housing 11 in such a posture that a pair of side plate parts 23 connected to left and right ends of the holding plate portion 22 extend backward and are housed in the front recess 12*f* and the side recess 12*c* of the housing 11, respectively, and a locking protrusion portion 13*a* housed in the opening 23*a* of the side plate portion 23 engages with a locking piece 23*b*. Thereby, the terminal holder 21 is attached and locked to the housing 11. At that time, the contact portion 54 of the terminal 51 protruding forward from the opening of the terminal housing cavity 15 in the front recess 12*f* of the housing 11 relatively moves forward with respect to the holding plate portion 22, and is inserted into the corresponding insertion hole 24.

The flange 53 disposed at a boundary between the contact portion 54 and the shaft portion 52 is housed in the recess 25 formed around the insertion hole 24 on a rear surface side of the holding plate portion 22, and a front surface 53*b* of the flange 53 comes into contact with a bottom surface portion 25*a* of the recess 25. As described above, since the tubular sealing member 30 is longer than the terminal housing cavity 15, the flange 53 of which the rear surface 53*a* comes into contact with the close contact outer end surface 36*b* of the elastic adhering member 36 positioned at the front end of the tubular sealing member 30 housed in the terminal housing cavity 15 protrudes forward from the opening of the terminal housing cavity 15. Accordingly, when the terminal holder 21 is attached to the housing 11 and the holding plate portion 22 is received in the front recess 12*f* of the housing 11, since the flange 53 relatively moves by being pressed backward by the holding plate portion 22, the tubular sealing member 30 is compressed in the longitudinal direction (front-rear direction), and the coil spring 71, the elastic tubular member 31, and the elastic adhering member 36 are in a state where a preload is applied.

The coil spring 71 is integrated with the elastic tubular member 31, but is not present in the elastic adhering member 36. Since the close contact inner end surface 36*c* of the elastic adhering member 36 is positioned outside the both ends of the coil spring 71 with respect to the longitudinal direction of the tubular sealing member 30, the elastic adhering member 36 positioned at the front end and the rear end of the tubular sealing member 30 is pressured by the front end and the rear end of the coil spring 71 and elastically deformed and thus functions as a sealing member. Therefore, when the preload is applied to the coil spring 71, the close contact outer end surface 36*b* of the front elastic adhering member 36 is pressed against the rear surface 53*a* of the flange 53 to function as a sealing surface which seals between the tubular sealing member 30 and the flange 53, and the close contact outer end surface 36*b* of the rear elastic adhering member 36 is pressed against the bottom surface 15*a* of the terminal housing cavity 15 to function as the sealing surface which seals between the tubular sealing member 30 and the cavity-recess partition wall 16*b*.

Thus, since the front elastic adhering member 36 is interposed between the front end of the coil spring 71 integrated with the elastic tubular member 31 and the flange 53 of the terminal 51 and the rear elastic adhering member 36 is interposed between the rear end of the coil spring 71 and the bottom surface 15*a* of the terminal housing cavity 15, even if the terminal 51 is slidably attached to the housing 11 in the front-rear direction, the terminal housing cavity 15 in front of the terminal holder 21 and behind the relay terminal housing cavity 15 can be shut off in a liquid-tight and air-tight manner, and dust, moisture, gas, and the like which exist in the space in front of the front surface 11*f* of the housing 11 can be reliably prevented from entering the relay terminal housing recess 16 and a space behind the relay terminal housing recess 16.

Therefore, the conduction due to the contact between the rear end side contact portion 52*a* of the terminal 51 protruding into the relay terminal housing recess 16 and the relay terminal 61 is reliably protected. More specifically, since the close contact outer end surface 36*b* of the front elastic adhering member 36 functions as the sealing surface and is pressed against the rear surface 53*a* of the flange 53 to reliably seal between the elastic adhering member 36 and the flange 53, and the close contact inner end surface 36*c* of the elastic adhering member 36 also functions as the sealing surface, and is pressed against the end surface 33*b* of the coupling portion 33 at the front end of the elastic tubular member 31 to reliably seal between the elastic adhering member 36 and the elastic tubular member 31, even if dust, moisture, gas, and the like which exist in the space in front of the front surface 11*f* of the housing 11 enter the terminal housing cavity 15 through the gap between the contact portion 54 and the insertion hole 24, the dust, moisture, gas, and the like cannot enter the space around the shaft portion 52, that is, the space in the central hole 31*a* of the elastic tubular member 31 and the central hole 36*a* of the elastic adhering member 36.

Further, since the close contact outer end surface 36*b* of the rear elastic adhering member 36 functions as the sealing surface and is pressed against the bottom surface 15*a* of the terminal housing cavity 15 to reliably seal between the elastic adhering member 36 and the cavity-recess partition wall 16*b*, and the close contact inner end surface 36*c* of the elastic adhering member 36 also functions as the sealing surface and is pressed against the end surface 33*b* of the coupling portion 33 on the rear end of the elastic tubular member 31 to reliably seal between the elastic adhering member 36 and the elastic tubular member 31, even if dust, moisture, gas, and the like enter the terminal housing cavity 15, the dust, moisture, gas, and the like cannot enter the space around the shaft portion 52. Therefore, the dust, moisture, gas, and the like do not enter the relay terminal housing recess 16 through the gap between the shaft portion 52 and the communication hole 15*b* penetrating through the cavity-recess partition wall 16*b*.

Further, the front elastic adhering member 36 mainly adheres to the rear surface 53*a* of the flange 53 to be responsible for dustproof and/or waterproof action, the rear elastic adhering member 36 mainly adheres to the bottom surface 15*a* of the terminal housing cavity 15 to be responsible for dustproof and/or waterproof action, and the elastic tubular member 31 is mainly compressed in the front-rear direction to be responsible for an action of pressing the front elastic adhering member 36 forward and pressing the rear elastic adhering member 36 backward. In this way, since the members responsible for different actions are separately molded, the influence of the deformation caused by the compression of the elastic tubular member 31 on the elastic adhering member 36 is suppressed, and the dustproof and/or waterproof action is not inhibited.

Furthermore, by making the hardness of the elastomer, which is the material of the elastic tubular member 31, relatively low and making the hardness of the elastomer, which is the material of the elastic adhering member 36, relatively high, the deformation caused by the compression of the elastic tubular member 31 on the elastic adhering member 36 can be further suppressed, and the dustproof and/or waterproof action can be made more reliably.

Next, a connection between a connector 1 and a mating connector will be described.

In the present embodiment, the connector 1 is attached to a device such as an electronic device or an electrical device (not shown) so that a rear portion of the housing 11 is incorporated in a recess or opening formed in a housing of the device, and an O-ring 19 is pressed against an inner wall surface of the recess or opening formed in the housing of the device to exhibit a sealing function. Note that the housing 11 of the connector 1 can be formed directly on the housing of the device. Accordingly, a rear portion of the housing 11 incorporated in the recess or opening formed in the housing of the device and a front portion of the housing 11 outside the housing of the device are shielded. Further, as described above, since the front elastic adhering member 36 is interposed between the front end of the coil spring 71 integrated with the elastic tubular member 31 and the flange 53 of the terminal 51, and the rear elastic adhering member 36 is interposed between the rear end of the coil spring 71 and the bottom surface 15*a* of the terminal housing cavity 15, it is possible to reliably prevent dust, moisture, gas, and the like which exist in the space in front of the front surface 11*f* of the housing 11 from entering into the relay terminal housing recess 16 and the space behind the relay terminal housing recess 16. Accordingly, it is possible to reliably prevent dust, moisture, gas, and the like from entering into the rear portion of the housing 11, which is incorporated in the recess or opening formed in the housing of the device, from the front portion of the housing 11 outside the housing of the device.

The contact portion 54 of the terminal 51 is connected to the mating connector by coming into contact with the mating terminal provided with the mating connector (not shown). The mating connector may be of any type or any shape, but here, description will be made assuming that the mating connector has a flat surface portion facing the front surface 11*f* of the housing 11 of the connector 1 and a pair of left and right flat mating terminals are exposed on the flat surface portion.

The connector 1 relatively moves forward from the state as shown in FIGS. 1A, 1B and 10 so as to approach the flat surface portion of the mating connector positioned in the front, and is connected to the mating connector. When the connector 1 is connected to the mating connector, since the front ends 54*a* of the contact portions 54 of each terminal 51 are pressed against the corresponding mating terminal of the mating connector, the holding plate portion 22 of the terminal holder 21 attached to the housing 11 approaches the flat surface portion of the mating connector and the terminal 51 slides with respect to the housing 11 and is relatively displaced backward. A sliding amount of the terminal 51 to the rear at this time is, for example, about 1.5 [mm], but can be changed as appropriate.

Then, the contact portion 54 slides backward in the insertion hole 24 of the holding plate portion 22, the protruding amount of the front end 54*a* of the contact portion 54 from the front surface of the holding plate portion 22 is decreased, and the flange 53 slides backward in the terminal housing cavity 15. Note that since the outer diameter of the contact portion 54 is set to be slightly smaller than the inner diameter of the insertion hole 24, the contact portion 54 is smoothly guided by the insertion hole 24, and the swing, rattling, and the like of the terminal 51 in directions other than the front-rear direction of the terminal 51 are regulated. The front surface 53*b* of the flange 53 is separated backward from the bottom surface portion 25*a* of the recess 25 of the holding plate portion 22, and the space is generated between the front surface 53*b* of the flange 53 and the holding plate portion 22. Further, since the shaft portion 52 of the terminal 51 slides backward, the protruding amount of the rear end side contact portion 52*a* from the cavity-recess partition wall 16*b* is increased in the device terminal housing recess 17. Note that when the shaft portion 52 slides backward, the rear end side contact portion 52*a* keeps the contact with the relay terminal 61 because the side surface thereof continues to be in sliding contact with the surface of the terminal contact portion 64*a* of the relay terminal 61.

Further, the front end surface 33*b* of the elastic tubular member 31 is displaced backward through the front elastic adhering member 36 by the flange 53 which slides backward in the terminal housing cavity 15, so the elastic tubular member 31 integrated with the coil spring 71 is further compressed in the front-rear direction. Accordingly, since the spring force exerted by the coil spring 71 is increased, and the front end 54*a* of the contact portion 54 of the terminal 51 is strongly pressed against the mating terminal of the mating connector, the state of conduction between the terminal 51 and the mating terminal is reliably maintained. Further, the force with which the front end and the rear end of the coil spring 71 press the front and rear elastic adhering members 36 is further increased, the close contact outer end surface 36*b* of the front elastic adhering member 36 is further pressed against the rear surface 53*a* of the flange 53 to seal between the tubular sealing member 30 and the flange 53, and the close contact outer end surface 36*b* of the rear elastic adhering member 36 is further pressed against the bottom surface 15*a* of the terminal housing cavity 15 to seal between the tubular sealing member 30 and the cavity-recess partition wall 16*b*. Accordingly, the sealing function of the front and rear elastic adhering members 36 is improved, and it is possible to further prevent dust, moisture, gas, and the like from entering.

In this way, in the present embodiment, the connector 1 includes a housing 11 which has a holding plate portion 22 in which an insertion hole 24 is formed and a terminal housing cavity 15 whose front and rear are defined by a cavity-recess partition wall 16*b* in which a communication hole 15*b* is formed, a terminal 51 which includes a shaft portion 52, a contact portion 54 connected to a tip of the shaft portion 52, a flange 53 disposed at a boundary between the contact portion 54 and the shaft portion 52, and a rear end side contact portion 52*a* in a rear end vicinity portion of the shaft portion 52, in which the contact portion 54 is slidably inserted into the insertion hole 24, the contact portion 54 protruding forward from the holding plate portion 22 can contact a mating terminal, the rear end vicinity portion of the shaft portion 52 is slidably inserted into the communication hole 15*b*, and the rear end side contact portion 52*a* protruding backward from the cavity-recess partition wall 16*b* can contact a relay terminal 61, and a tubular sealing member 30 which includes a central hole 31*a* into which the shaft portion 52 is slidably inserted, an elastic tubular member 31 having a coil spring 71 embedded therein, a central hole 36*a* into which the shaft portion 52 is slidably inserted, and an elastic adhering member 36 attached to front and back ends of the elastic tubular member 31 and urges the flange 53 forward.

As a result, the connector 1 not only has a simple configuration, is easily assembled, and produced at low cost, but also can reliably maintain liquid tightness and air tightness and seal between the front and rear of the housing 11 in an air-tight and liquid-tight manner. Further, the terminal 51 can be slidably held, and furthermore, the state of conduction between the mating terminal of the mating connector and the relay terminal 61 can be reliably maintained. Therefore, the reliability can be improved.

Further, the elastic adhering member 36 attached to the front end of the elastic tubular member 31 is pressed against the flange 53 and seals between the flange 53 and the tubular sealing member 30, and the elastic adhering member 36 attached to the rear end of the elastic tubular member 31 is pressed against the cavity-recess partition wall 16*b* and seals between the cavity-recess partition wall 16*b* and the tubular sealing member 30. Accordingly, the liquid tightness and the air tightness can be reliably maintained, and it is possible to prevent dust, moisture, gas, and the like from entering the space behind the cavity-recess partition wall 16*b* through the gap between the rear end vicinity portion of the shaft portion 52 and the communication hole 15*b* of the cavity-recess partition wall 16*b*.

Further, in the state where the contact portion 54 is not in contact with the mating terminal, the preload is applied to the coil spring 71, and the flange 53 is pressed against the holding plate portion 22. Accordingly, even when the connector 1 is in a state before the connector 1 is connected to the mating connector, the gap between the flange 53 and the holding plate portion 22 is securely sealed, so the space between the front and rear of the housing 11 can be sealed in an airtight and liquid-tight manner.

Furthermore, the tubular sealing member 30 as a terminal sealing member includes the shaft portion 52 and the flange 53 disposed on the shaft portion 52, and is attached to the terminal 51 that can slide in the front-rear direction. The terminal sealing member includes the elastic adhering member 36 which includes the coil spring 71 attached around the shaft portion 52 and urging the flange 53 forward and includes the elastic tubular member 31 having the coil spring 71 embedded therein and the central hole 36*a* into which the shaft portion 52 is slidably inserted, and is attached to the front and back ends of the elastic tubular member 31. Therefore, the coil spring 71 is easy to handle, the connector 1 is easy to assemble, and the manufacturing cost can be reduced.

Further, the elastic tubular member 31 includes the main body portion 32 whose outer shape is a right quadrangular prism, and the coupling portion 33 having the cylindrical outer shape and integrally connected to the front and back ends of the main body portion 32, in which the outer diameter of the coupling portion 33 is substantially the same as the length of the diagonal line of the transverse cross-section of the main body portion 32. Further, the outer surface of the coil spring 71 comes close to the plane of the outer periphery of the main body portion 32. Further, the elastic adhering member 36 includes the main body portion 36*e* having a cylindrical outer shape and the small diameter tubular portion 36*d* protruding from the close contact inner end surface 36*c* of the main body portion 36*e*, in which the small diameter tubular portion 36*d* is housed in the counterbore hole 33*a* formed on the end surface 33*b* of the coupling portion 33 and is inserted into the vicinity of the end portion of the coil spring 71. Further, the elastic tubular member 31 is formed of an elastomer, and the elastic adhering member 36 is formed of an elastomer having a hardness higher than that of the elastic tubular member 31.

Furthermore, a method of producing a tubular sealing member tubular sealing member 30 as the sealing member for the terminal includes molding an elastic adhering member 36 which includes a main body portion 36*e* having a cylindrical outer shape and a central hole 36*a* by filling an elastic material in a first mold, setting a pair of the elastic adhering members 36 in a second mold in a posture where the elastic adhering members 36 face each other, setting a coil spring 71 in the second mold so that the coil spring 71 is positioned between the pair of elastic adhering members 36, inserting a third mold having a round bar shape into the coil spring 71, and molding an elastic tubular member 31 including a central hole 31*a* and having the coil spring 71 embedded therein by closing the second mold and filling the elastic material in the second mold. As a result, the tubular sealing member 30 can be manufactured easily.

Further, when the second mold is closed, the mold surface forming the flat surface on the outer circumferential surface of the elastic tubular member 31 supports a portion of the outer circumferential surface of the coil spring 71. As a result, the coil spring 71 can be positioned easily and accurately. Further, the elastic material filled in the first mold is an elastomer, and the elastic material filled in the second mold is an elastomer having a hardness lower than that of the elastomer filled in the first mold.

It should be noted that the disclosure herein describes features related to preferred and exemplary embodiments. Those skilled in the art can naturally understand various other embodiments, modifications and variations within the scope and spirit of the claims appended hereto by reviewing the disclosure of the present specification.

The present disclosure can be applied to a terminal sealing member, a method of producing the same, and a connector including the same.

The invention claimed is:

1. A terminal sealing member which is configured to be operatively associated with a terminal having a shaft portion and a flange disposed on the shaft portion, the terminal sealing member comprising:

an urging member which is configured to be positioned around the shaft portion and is configured to urge the flange forward;

an elastic tubular member having a central hole which is configured to have the shaft portion be slidably inserted thereinto; and an elastic adhering member having a central hole which is configured to have the shaft portion be slidably inserted thereinto, the elastic adhering member being attached to front and back ends of the elastic tubular member, wherein the elastic tubular member includes a main body portion whose outer shape is a right quadrangular prism, and a coupling portion which has a cylindrical outer shape and is integrally connected to the front and back ends of the main body portion, and an outer diameter of the coupling portion is substantially the same as a length of a diagonal line of a transverse cross-section of the main body portion.

2. The terminal sealing member according to claim 1, wherein the urging member is a coil spring, and an outer surface of the urging member comes close to a plane of an outer periphery of the main body portion.

3. The terminal sealing member according to claim 2, wherein the elastic adhering member includes a main body portion having a cylindrical outer shape and a small diameter tubular portion protruding from one end surface of the main body portion, and the small diameter tubular portion is housed in a counterbore hole formed on an end surface of the coupling portion and is inserted into the vicinity of an end portion of the coil spring.

4. A terminal sealing member which is configured to be operatively associated with a terminal having a shaft portion and a flange disposed on the shaft portion, the terminal sealing member comprising:

an urging member which is configured to be positioned around the shaft portion and is configured to urge the flange forward;

an elastic tubular member having a central hole which is configured to have the shaft portion be slidably inserted thereinto; and an elastic adhering member having a central hole which is configured to have the shaft portion be slidably inserted thereinto, the elastic adhering member being attached to front and back ends of the elastic tubular member, wherein the elastic tubular member is formed of an elastomer, and the elastic adhering member is formed of an elastomer having a hardness higher than that of the elastic tubular member.

5. A method of producing a terminal sealing member, comprising:

molding an elastic adhering member which includes a main body portion having a cylindrical outer shape and a central hole by a first elastic material;

setting a pair of the elastic adhering members in a posture where the elastic adhering members face each other;

setting an urging member so as to be positioned between the pair of elastic adhering members; and molding an elastic tubular member which includes a central hole and has the urging member embedded therein by a second elastic material, wherein the first elastic material is an elastomer, and the second elastic material is an elastomer having a hardness lower than that of the first elastic material.

6. The method of producing a terminal sealing member according to claim 5, wherein the urging member is a coil spring and the elastic tubular member is molded by supporting a portion of an outer peripheral surface of the coil spring.

7. A connector, comprising:

a housing which has a terminal housing recess whose front and rear are defined by a front partition wall provided with a front through hole and a rear partition wall provided with a rear through hole;

a terminal which includes a shaft part, a contact portion connected to a tip of the shaft part, a flange disposed at a boundary between the contact portion and the shaft part, and a rear end side contact portion in a rear end vicinity portion of the shaft part, with the contact portion being slidably inserted into the front through hole, the contact portion protruding forward from the front partition wall contacting a front mating terminal, a rear end vicinity portion of the shaft portion being slidably inserted into the rear through hole, and the rear end side contact portion protruding backward from the rear partition wall contacting a rear mating terminal; and a terminal sealing member which includes a central hole into which the shaft portion is slidably inserted, an elastic tubular member having an urging member embedded therein, a central hole into which the shaft portion is slidably inserted, and an elastic adhering member attached to front and back ends of the elastic tubular member and urges the flange forward, wherein the elastic tubular member is formed of an elastomer, and the elastic adhering member is formed of an elastomer having a hardness higher than that of the elastic tubular member.

8. The connector according to claim 7, wherein the elastic adhering member attached to an front end of the elastic tubular member is pressed against the flange and seals between the flange and the terminal sealing member, and the elastic adhering member attached to the rear end of the elastic tubular member is pressed against the rear partition wall and seals between the rear partition wall and the terminal sealing member.

9. The connector according to claim 7, wherein in a state in which the contact portion does not contact the front mating terminal, the urging member is applied with a preload and the flange is pressed against the front partition wall.

10. A terminal sealing member which is configured to be operatively associated with a terminal having a shaft portion and a flange disposed on the shaft portion, the terminal sealing member comprising:

a first elastic member having first and second opposite ends and an outer surface, the first elastic member having a first hole which extends therethrough from the first end to the second end, the first hole defining an inner surface of the first elastic member;

an urging member which is at least partially embedded within the first elastic member between the inner and outer surfaces thereof; and a pair of second elastic members, each second elastic member having a second hole which extends therethrough, the second hole defining an inner surface of the second elastic member, a first one of the second elastic members being provided at the first end of the first elastic member, a second one of the second elastic members being provided at the second end of the first elastic member, wherein the inner surfaces of the first and second elastic members are sized to allow the shaft portion of the terminal to be slidably inserted in and out of the first and second holes in a front-rear direction, and wherein the urging member is configured to urge the flange of the terminal forward when the shaft portion is inserted in the first and second holes of the first and second elastic members.

11. The terminal sealing member according to claim 10, wherein the first elastic member comprises a main body portion and first and second coupling members on opposite ends of the main body portion, wherein the first one of the second elastic members is provided at the first coupling member, and wherein the second one of the second elastic members is provided at the second coupling member.

12. The terminal sealing member according to claim 11, wherein the first hole is at least partially formed as a counterbore in each of the first and second coupling members.

13. The terminal sealing member according to claim 11, wherein the outer surface of the main body portion is formed in a shape of a square in a transverse cross-section, and wherein the outer surface of the first and second coupling members are cylindrical in configuration.

14. The terminal sealing member according to claim 11, wherein the urging member is at least partially exposed on the outer surface of the main body portion.

15. The terminal sealing member according to claim 10, wherein the first elastic member is formed of an elastomer, and the pair of second elastic members are formed of an elastomer having a hardness higher than that of the first elastic member.

16. The terminal sealing member according to claim 10, wherein the urging member is a coil spring and the first elastic member is molded by supporting a portion of an outer peripheral surface of the coil spring.

* * * * *